US005633980A

United States Patent [19]

Ozawa

[11] Patent Number: 5,633,980

[45] Date of Patent: May 27, 1997

[54] VOICE COVER AND A METHOD FOR SEARCHING CODEBOOKS

[75] Inventor: Kazunori Ozawa, Tokyo, Japan

[73] Assignee: NEC Corporation, Tokyo, Japan

[21] Appl. No.: 355,313

[22] Filed: Dec. 12, 1994

[30] Foreign Application Priority Data

Dec. 10, 1993 [JP] Japan ..... 5-310522
Mar. 2, 1994 [JP] Japan ..... 6-032104

[51] Int. Cl.[6] ..... G10L 9/00

[52] U.S. Cl. ..... 395/2.31; 395/2.32; 395/2.3

[58] Field of Search ..... 395/2.28, 2.31, 395/2.39, 2.32, 2; 381/38, 31, 36, 40

[56] References Cited

U.S. PATENT DOCUMENTS

| | | | |
|---|---|---|---|
| 4,912,764 | 3/1990 | Hartwell et al. | 381/38 |
| 5,012,517 | 4/1991 | Wilson et al. | 381/31 |
| 5,091,944 | 2/1992 | Takahashi | 381/36 |
| 5,195,168 | 3/1993 | Yong | 395/2 |
| 5,265,167 | 11/1993 | Akamine et al. | 381/40 |
| 5,301,255 | 4/1994 | Nagai et al. | 395/2.39 |
| 5,327,519 | 7/1994 | Haggevist et al. | 395/2.28 |
| 5,432,883 | 7/1995 | Yoshihara | 395/2.28 |
| 5,471,558 | 11/1995 | Tsutsui | 395/2.28 |
| 5,475,789 | 12/1995 | Nishiguchi | 395/2 |
| 5,485,581 | 1/1996 | Miyano et al. | 395/2.32 |

OTHER PUBLICATIONS

Schroeder, Manfred R. et al., "Code-Excited Linear Prediction (CELP): High-Quality Speech at Very Low Bit Rates", *Proc. ICASSP*, 1985, pp. 937–940.

Kleijn, W. B. et al., "Improved Speech Quality and Efficient Vector Quantization in SELP", *ICASSP*, 1988, pp. 155–158.

Atal, Bishnu S. et al., "A New Model of LPC Excitation for Producing Natural-Sounding Speech at Low Bit Rates", *Proc. ICASSP*, 1982, pp. 614–617.

*Primary Examiner*—Allen R. MacDonald
*Assistant Examiner*—Vijay B. Chawan
*Attorney, Agent, or Firm*—Foley & Lardner

[57] ABSTRACT

After dividing voice signals into subframes, a voice coder calculates auditory sense masking threshold values for each subframe with a masking threshold value calculating circuit, and transforms the auditory sense masking threshold values to auditory sense weighting filter coefficients. An auditory sense weighting circuit performs auditory sense weighting to the signals using the auditory sense weighting filter coefficients and searches excitation codebooks or multipulses using auditory sense weighted signals.

48 Claims, 10 Drawing Sheets

VOICE COVER AND A METHOD FOR SEARCHING CODEBOOKS

BACKGROUND OF THE INVENTION

The present invention relates to voice coding techniques for encoding voice signals in high quality at low bit rates, especially at 8 to 4.8 kb/s.

As a method for coding voice signals at low bit rates of about 8 to 4.8 kb/s, for example, there is a CELP (Code Excited LPC Coding) method described in the paper titled "Code-excited linear prediction: High quality speech at very low bit rates" (Proc. ICASSP, pp. 937–940, 1985) by M. Schroeder and B. Atal (reference No. 1) and the paper titled "Improved speech quality and efficient vector quantization in SELP" (ICASSP, pp. 155–158, 1988) by Kleijn et al. (reference No. 2).

In the method described in these papers, spectral parameters representing spectral characteristics of voice signals are extracted in the transmission side from voice signals for each frame (20 ms, for example). Then, the frames are divided into subframes (5 ms, for example), and pitch parameters of an adaptive codebook representing long-term correlation (pitch correlation) are extracted so as to minimize a weighted squared error between a signal regenerated based on a past excitation signal for each subframe and the voice signal. Next, the subframe's voice signals are predicted in long-term based on these pitch parameters, and based on residual signals calculated through this long-term prediction, one kind of noise signal is selected so as to minimize weighted squared error between a signal synthesized from signals selected from a codebook consisting of pre-set kinds of noise signals and the voice signal, and an optimal gain is calculated. Then, an index representing a type of the selected noise signal, gain, the spectral parameter and the pitch parameters are transmitted.

In addition, as another method for coding voice signals at low bit rates of about 8 to 4.8 kb/s, the multi-pulse coding method described in the paper titled "A new model of LPC excitation for producing natural-sounding speech at low bit rates" (Proc. ICASSP, pp. 614–617, 1982) by B. Atal et al. (reference No. 3) etc. is known.

In the method of reference No. 3, the residual signal of above-mentioned method is represented by a multi-pulse consisting of a pre-set number of pulse strings of which amplitude and locations are different from others, amplitude and location of the multi-pulse are calculated. Then, amplitude and location of the multi-pulse, the spectral parameter and the pitch parameters are transmitted.

In the prior art described in references No. 1, No. 2 and No. 3, as an error evaluation criterion, a weighted squared error between a supplied voice signal and a regenerated signal from the codebook or the multi-pulse is used when searching a codebook consisting of multi-pulses, adaptive codebook and noise signals.

The following equation shows such a weighted scale criterion.

$$w(z) = \left[ 1 - \sum_{i=1}^{p} a_i \gamma_1^i z^{-i} \right] / \left[ 1 - \sum_{i=1}^{p} a_i \gamma_2^i z^{-i} \right] \quad (1)$$

Where, W(z) represents transfer characteristics of a weighting filter, and $a_i$ is a linear prediction coefficient calculated from a spectral parameter. $\gamma_1^i$, $\gamma_2^i$ are constants for controlling a weighting quantity, they are typically set such that $0<\gamma_2<\gamma_1<1$.

However, there is a problem that speech quality of regenerated voices using code vectors selected with this criterion or calculated multi-pulses do not always fit to natural auditory feeling because this evaluation criterion does not match with natural auditory feeling.

Moreover this problem becomes particularly noticeable the bit rate was reduced and the codebook was reduced in size.

Furthermore, in the above-mentioned prior art, the number of bits of codebook in each subframe is supposed constant when searching a codebook consisting of noise signals. Additionally, the number of multipulses in a frame or a subframe is also constant when calculating a multipulse.

However, power of voice signals remarkably varies as time passes, so it has been difficult to code voices to a high quality by a method using a constant number of bits where the power of voice signals varies as time passes. Especially, this problem becomes serious under the conditions that bit rates are reduced and sizes of codebooks are minimized.

SUMMARY OF THE INVENTION

It is an object of the present invention to solve the above-mentioned problems.

Another object of the present invention is to provide a voice coding art matching auditory feeling.

Moreover, another object of the present invention is to provide a voice coding art enabling to reduce bit rates than prior art.

The above-mentioned objects of the present invention are achieved by a voice coder comprising a masking calculating means for calculating masking threshold values from supplied discrete voice signals based on auditory sense masking characteristics, auditory sense weighting means for calculating filter coefficients based on the making threshold values and weighting input signals based on the filter coefficients, a plurality of codebooks, each of them consisting of a plurality of code vectors, and a searching means for searching a code vector that minimizes output signal power of the auditory sense weighting means from the codebooks.

The voice coder of the present invention performs, for each of subframes created by dividing frames, auditory sense weighting calculated based on auditory sense masking characteristics to signals supplied to adaptive codebooks, excitation codebooks or multi-pulse when searching adaptive codebooks and excitation codebooks or calculating multi-pulses.

In auditory sense weighting, masking threshold values are calculated based on auditory sense masking characteristics, an error scale is calculated by performing auditory sense weighting to supplied signals based on the masking threshold values. Then, an optimal code vector is calculated from the codebooks so as to minimize the error scale. Namely, a code vector that minimizes weighted error power as shown in the following equation.

$$E = \sum_{n=0}^{N-1} [\{x(n) - \gamma_j c_j(n) * h(n) * w_m(n)\}]^2 \quad (2)$$

This and other objects, features and advantages of the present invention will become more apparent upon a reading of the following detailed description and drawings.

DESCRIPTION OF THE PREFERRED EMBODIMENTS

First, the first embodiment of the present invention is explained.

In this first embodiment, an error signal output from an auditory sense weighting filter based on masking threshold values is used for searching an excitation codebook.

Figure 1:
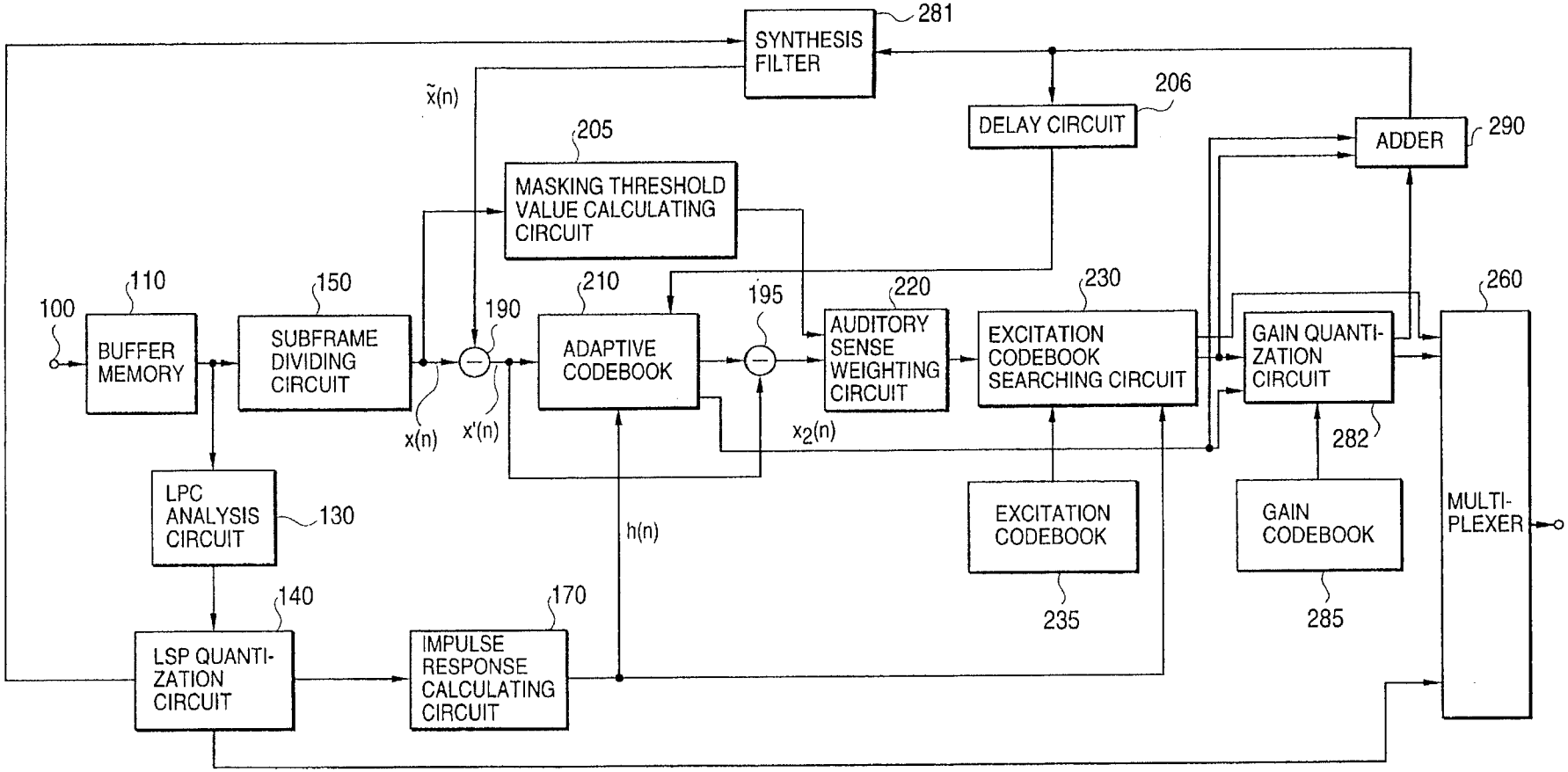
FIG. 1 is a block diagram showing the first embodiment of the present invention.

FIG. 1 is a block diagram of a voice coder according to the present invention.

In the transmission side of FIG. 1, voice signals are input from an input terminal 100, and voice signals of one frame (20 ms, for example) are sorted in a buffer memory 110. An LPC analyzer 130 performs well-known LPC analysis from one frame voice signal, and calculates LSP parameters representing spectral characteristics of voice signals for a pre-set number of orders.

Next, an LSP quantization circuit 140 outputs a code $l_k$ obtained by quantizing LSP parameters with a pre-set quantization bit number to a multiplexer 260. Then, it decodes the code $l_k$, transforms a linear prediction coefficient $a_i'$ (i=1 to L), and outputs a result to an impulse response calculator 170 and a synthesis filter 281.

It is to be noted that it is possible to refer to LSP parameter coding, a transforming method of LSP parameter and linear prediction coefficient to the paper titled "Quantizer design in LSP speech analysis-synthesis" (IEEE J. Sel. Areas On Commun., PP. 432–440, 1988) by Sugamura et al. (reference No. 4) and so on. Also, it is possible to use vector to scalar quantization or other well-known vector quantizing methods for more efficiently quantizing LSP parameters. For vector to scalar quantization of SSP, it is possible to refer to the paper titled "Transform Coding of Speech using a Weighted Vector Quantizer" (IEEE J. Sel. Areas, Commun., pp. 425–431, 1988) by Moriya et al. (reference No. 5) and so on.

A subframe dividing circuit 150 divides one frame voice signal into subframes. As an example, the subframe length is 5 ms for a 20 ms frame length.

A subtracter 190 subtracts an output wave x(n) of the synthesis filter 281 from the voice signal x(n), and outputs a signal x'(n).

The adaptive codebook 210 inputs an input signal v(n) of the synthesis filter 281 through a delay circuit 206, and inputs a weighted impulse response h(n) from an impulse response output circuit 170 and the signal x"(n) from the subtracter 190. Then, it performs long-term correlation pitch prediction based on these signals and calculates delay M and gain β as pitch parameters.

In this example, the adaptive codebook prediction order is 1. However, the value can be 2 or more. Moreover, the papers (references No. 1, 2 and so on) can be referred to for calculation of delay M in the adaptive codebook.

Next, using the calculated gain β, an adaptive code vector β·v(n−M)*h(n) is calculated. Then, the subtracter 195 subtracts the adaptive code vector from the signal x'(n), and outputs a signal $x_z(n)$.

$$x_z(n)=x'(n)-\beta*v(n-M)*h(n) \tag{3}$$

Where, $x_z$ (n) is an error signal, x'(n) is an output signal of the subtracter 190, v(n) is a past synthesis filter driving signal, and h(n) is an impulse response of the synthesis filter calculated from linear prediction coefficients.

A masking threshold value calculator 205 calculates a spectrum X(k) (k=0 to N−1) by FFT transforming the voice signal x(n) at N points, next calculates a power spectrum $|X(k)|^2$, and calculates power or RMS for each critical band by analyzing the result using a critical band filter or an auditory sense model. The following equation is used for power calculation.

$$B(i)=\sum_{k=bli}^{bhi}|X(k)|^2 \ (i=1 \text{ to } R) \tag{4}$$

Where, $bl_i$, $bh_i$ respectively shown lower limit frequency and upper limit frequency of an i-th critical band. R corresponds to the number of critical bands included in a voice signal band.

Next, a masking threshold value C(i) in each critical band is calculated using the values of the equation (4), and output.

Here, as a method of calculating masking threshold values, for example, a method using values obtained through auditory sense psychological experiments is known. It is possible to refer in detail to the paper titled "Transform coding of audio signals using perceptual noise criteria" (IEEE J. Sel. Areas on Commun., pp. 314–323, 1988) by Johnston et al. (reference No. 6) or the paper titled "Vector quantization and perceptual criteria in SVD based CELP coders" (ICASSP, pp. 33–36, 1990) by R. Drogo de lacovo et al. (reference No. 7).

Moreover, for critical band filters or critical band analysis, for example, it is possible to refer to the fifth chapter (reference No. 8) of the book titled "Foundation of modern auditory theory" and so on by J. Tobias. In addition, for auditory models, for example, it is possible to refer to the paper titled "A computational model for the peripheral auditory system: Application to speech recognition research" (Proc. ICASSP, pp. 1983–1986, 1986) by Seneff (reference No. 9) and so on.

Next, each masking threshold value sc(i) is transformed to a power value to obtain a power spectrum, and an auto-correlation function r(j) (j=0 . . . N−1) is calculated through inverse FFT operation.

Then, a filter coefficient $b_i$ (i=1 . . . P) is calculated by operating well-known linear prediction analysis to P+1 auto-correlation functions.

The auditory sense weighting circuit 220 performs weighting, according to the following equation, to the error signal $x_z(n)$ obtained by the equation (3) in the adaptive codebook 210, using the filter coefficient bi, and a weighted signal $x_{zm}(n)$ is obtained.

$$x_{zm}(n)=x_z(n)*W_m(n) \tag{5}$$

Where, $W_m(n)$ is an impulse response of an auditory sense weighting filter having the filter coefficient $b_i$.

Here, for the auditory sense weighting filter, a filter having a transfer function represented by the following equation (6) can be used.

$$H(z)=\left[1-\sum_{i=1}^{M} b_i r_1^i Z^{-1}\right] / \left[1-\sum_{i=1}^{M} b_i r'_2 Z^{-1}\right] \quad (6)$$

Where, $r_2$ and $r_1$ are constants meeting the constraint $0 \leqq r_2 < r_1 \leqq 1$.

Next, an excitation codebook searching circuit 230 selects an excitation code vector so as to minimize the following equation (7).

$$\sum_{n=0}^{N-1} [x_{zm}(n) - r_j \cdot C_j(n) * h(n) * W_m(n)]^2 \quad (7)$$

Where, $\gamma_j$ is an optimal gain to the code vector $c_j(n)$ (j=0 . . . $2^B-1$, where B is a number of bits of an excitation codebook).

It is to be noted that the excitation codebook 235 is made in advance through training. For example, for details on the codebook design method by training, it is possible to refer to the paper titled "An Algorithm for Vector Quantization Design" (IEEE Trans. COM-28, pp. 84–95, 1980) by Linde et al. (reference No. 10) and so on.

A gain quantization circuit 282 quantizes gains of the adaptive codebook 210 and the excitation codebook 235 using the gain codebook 285.

An adder 290 adds an adaptive code vector of the adaptive codebook 210 and an excitation code vector of the excitation codebook searching circuit 230 as below, and outputs a result.

$$v(n)=\beta' * v(n-M)+r' c_j(n) \quad (8)$$

A synthesis filter 281 inputs an output v(n) of the adder 290, calculates synthesized voices for one frame according to the following equation, and, in addition, inputs a zero string to the filter for another one frame to calculate a response signal string, and outputs a response signal string for one frame to the subtracter 190.

$$x(n) = V(n) + \sum_{i=1}^{P} a_i' x(n-1) \quad (9)$$

$$V(n) = \begin{cases} V(n) & (0 \leqq n \leqq N-1) \\ 0 & (N \leqq n \leqq 2N-1) \end{cases} \quad (10)$$

A multiplexer 260 combines output coded strings of the LSP quantizer 140, the adaptive codebook 210 and the excitation codebook searching circuit 230, and outputs a result.

This is the explanation of the first embodiment.

Next, the second embodiment is explained.

Figure 2:
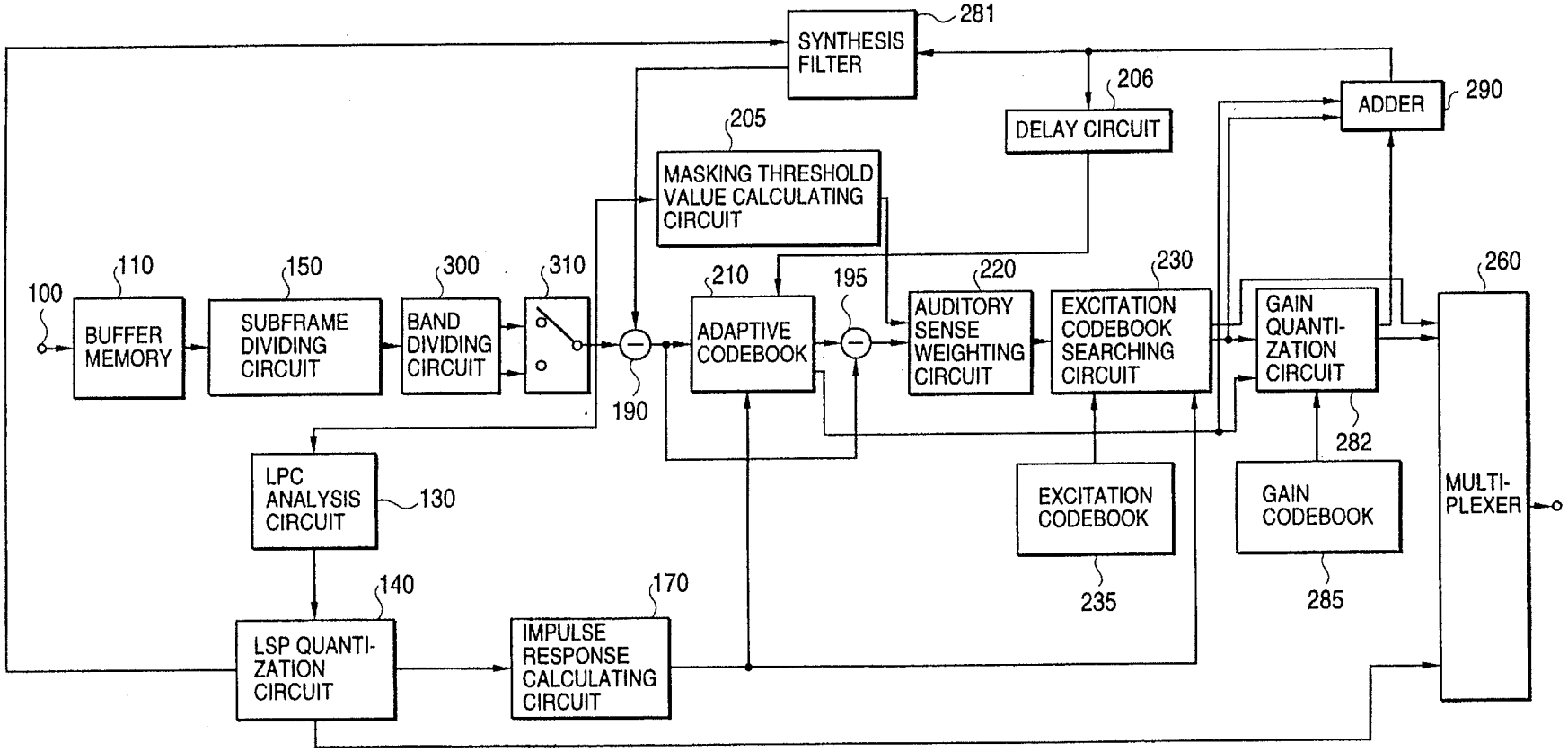
FIG. 2 is a block diagram showing the second embodiment of the present invention.

FIG. 2 is a block diagram showing the second embodiment. In FIG. 2, a component referred with the same number as that in FIG. 1 operates similarly in FIG. 1, so explanations for it is omitted.

In the second embodiment, a band dividing circuit 300 for subbanding in advance input voices is further provided to the first embodiment. Here, for simplicity, the number of divisions used is two and a method using QMF filter is used for the dividing method. Under these conditions, signals of lower frequency and that of higher frequency are output.

For example, letting the frequency bandwidth of input voice be fw(Hz), it is possible to divide a band as 0 to fw/2 for the lower band and fw/2 to fw for the higher band.

Then, a switch 310 is set to a first port when processing lower band signals and is set to a second port when processing higher band signals.

It is to be noted that, as a method for subbanding using QMF filters, for example, it is possible to refer to the book titled "Multirate Signal Processing" (Prentice-Hall, 1983) by Crochiere et al. (reference No. 11) and so on. In addition, as other methods, it is possible to consider a method for operating FFT to signals and performing frequency dividing on FFT, then operating inverse FFT.

Here, to a voice signal in each band that is subbanded, auditory sense weighting filter coefficients are calculated in the same manner as the first embodiment, auditory sense weighting is performed, and searching of an excitation codebook is conducted.

It is possible to prepare two kinds of excitation codebooks for the lower band and the higher band and to use them by switching.

This is the explanation for the second embodiment of the present invention.

Next, the third embodiment is explained.

The third embodiment further comprises a bit allocation section for allocating quantization bits to voice signals in subbanded bands in addition to the second embodiment.

Figure 3:
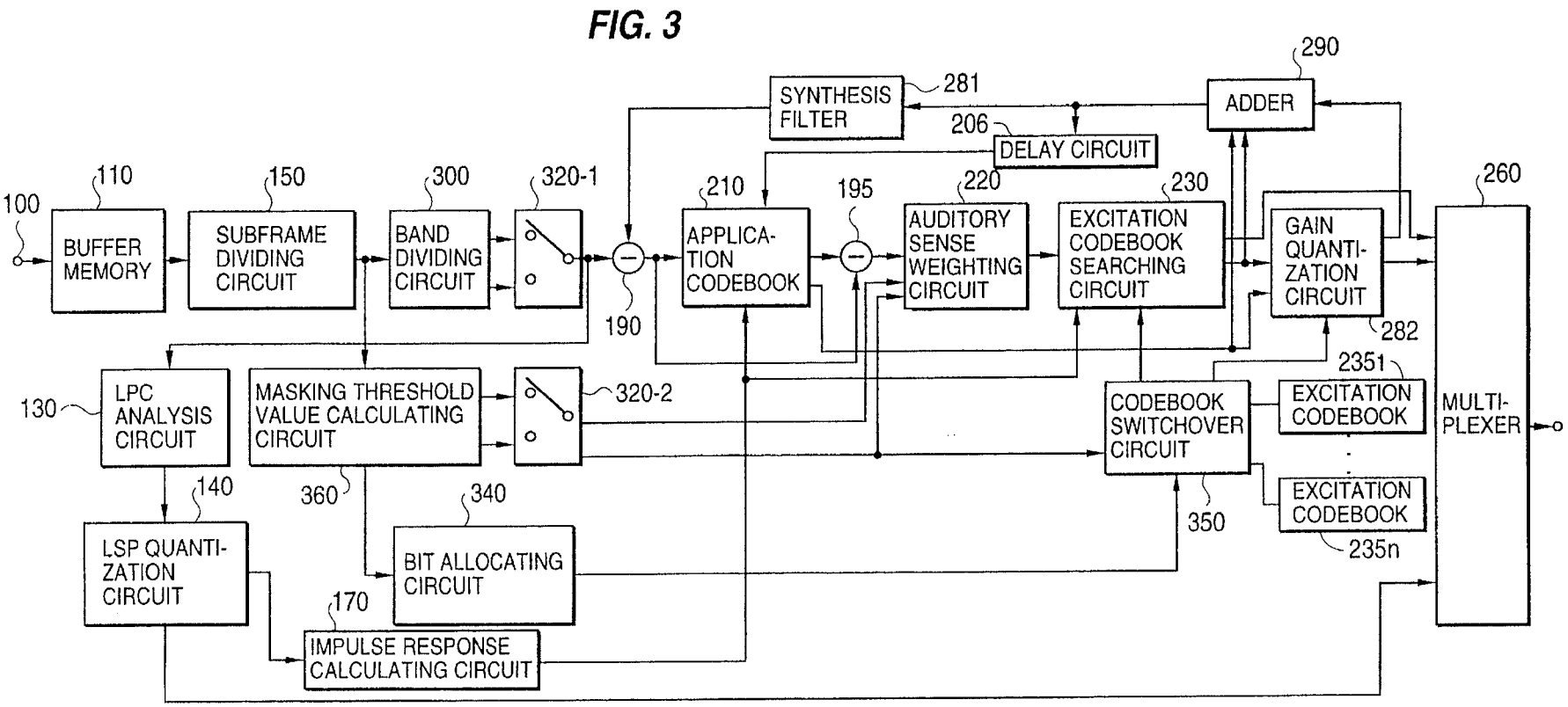
FIG. 3 is a block diagram showing the third embodiment of the present invention.

FIG. 3 is a block diagram showing the third embodiment. In this figure, a component referred with the same number as that of FIG. 1 and FIG. 2 is omitted to be explained because it operates as described in FIG. 1 and FIG. 2.

In FIG. 3, switch 320-1 and 320-2 switches the circuit to the lower band or the higher band, and output lower band signals or higher band signals, respectively. The switch 320-2 outputs information indicating as to where an output signal belongs, the lower band or the higher band, to the codebook switching circuit 350.

A masking threshold value calculator 360 calculates masking threshold values in all bands for signals that are not subbanded yet, and allocates them to the lower band or the higher band. Then, the masking threshold value calculator 360 calculates auditory sense weighting filter coefficients for the lower band or the higher band in the same manner as the first embodiment, and outputs them to the auditory sense weighting circuit 220.

Using outputs of the masking threshold value calculator 360, a bit allocation calculator 340 allocates a number of quantization bits in the lower band and the higher band, and outputs results to a codebook switching circuit 350. As bit allocation methods, there are some methods, for example, a method using a power ratio of a subbanded lower band signal and a subbanded higher band signal, or a method using a ratio of a lower band mean or minimum masking threshold value and a higher band mean or minimum masking threshold value when calculating masking threshold values in the masking threshold value calculator 360.

The codebook switching circuit 350 inputs a number of quantization bits from the allocation circuit 340, inputs lower band information and higher band information from the switch 320-2, and switches excitation codebooks and gain codebooks. Here, it is possible to prepare in advance the codebooks by using training data, or the codebook can be a random numbers codebook having predetermined stochastic characteristics.

Here, for bit allocation, it is possible to use another well-known method such as a method using a power ratio of the lower band and the higher band.

The above is the explanation for the third embodiment of the present invention.

Next, the fourth embodiment is explained.

In the fourth embodiment, a multi-pulse calculator 300 for calculating multi-pulses is provided, instead of the excitation codebook searching circuit 230.

Figure 4:
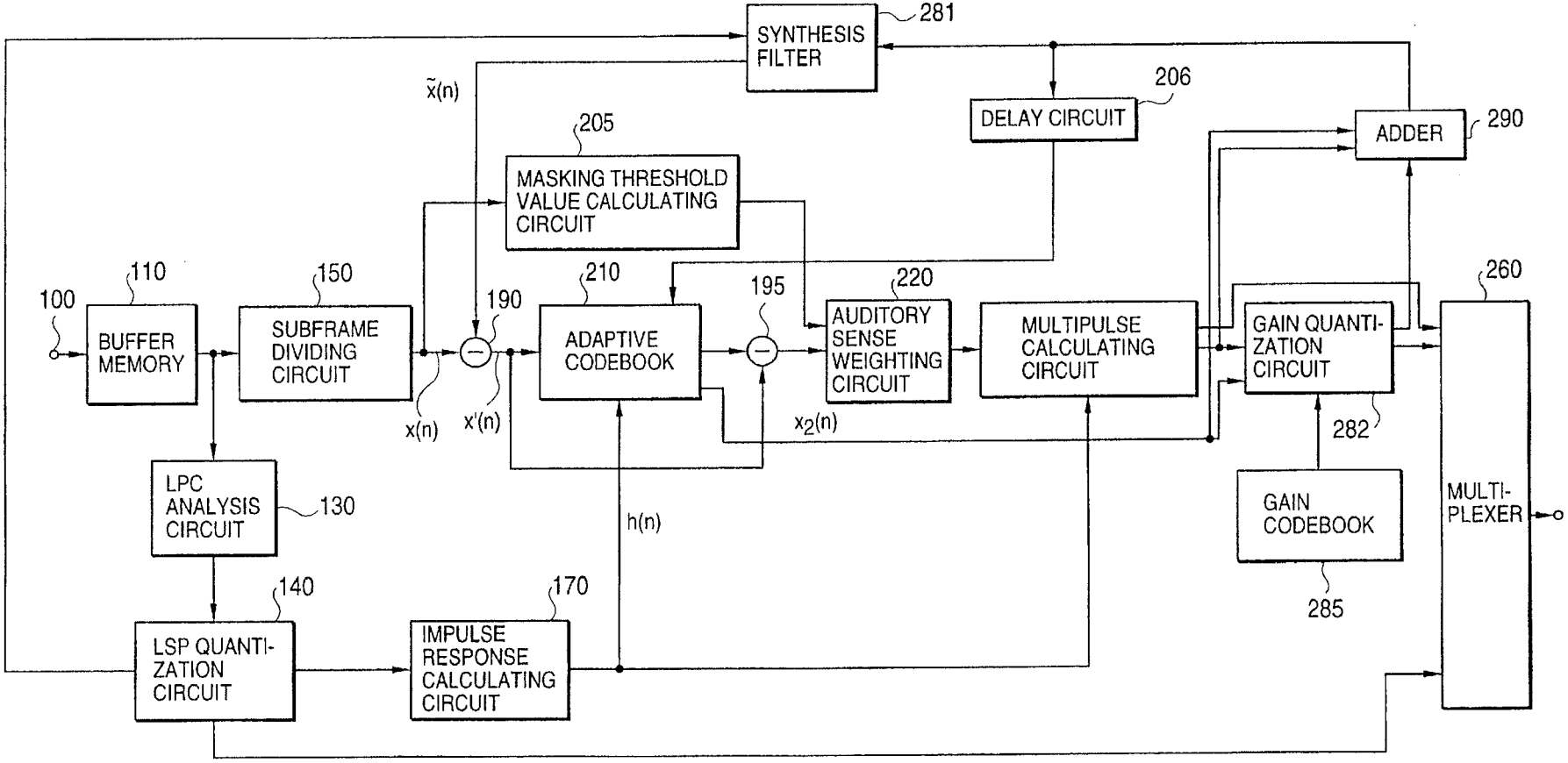
FIG. 4 is a block diagram showing the fourth embodiment of the present invention.

FIG. 4 is a block diagram of the fourth embodiment. In FIG. 4, a component referred with the same number as that of FIG. 1 is omitted to be explained, because it operates similarly as described in FIG. 1.

The multi-pulse calculator 300 calculates amplitude and location of a multi-pulse that minimizes the following equation.

$$D=\sum_{n=0}^{N-1}\left[x_{zm}(n)-\sum_{j=1}^{k} g_i\cdot h(n-m_j)*W_m(n)\right]^2 \quad (11)$$

Where, $g_j$ is j-th multi-pulse amplitude, $m_j$ is j-th multi-pulse location, k is a number of multi-pulses.

The above is all of the explanations needed for the fourth embodiment of the present invention.

Next, the fifth embodiment is explained.

Figure 5:
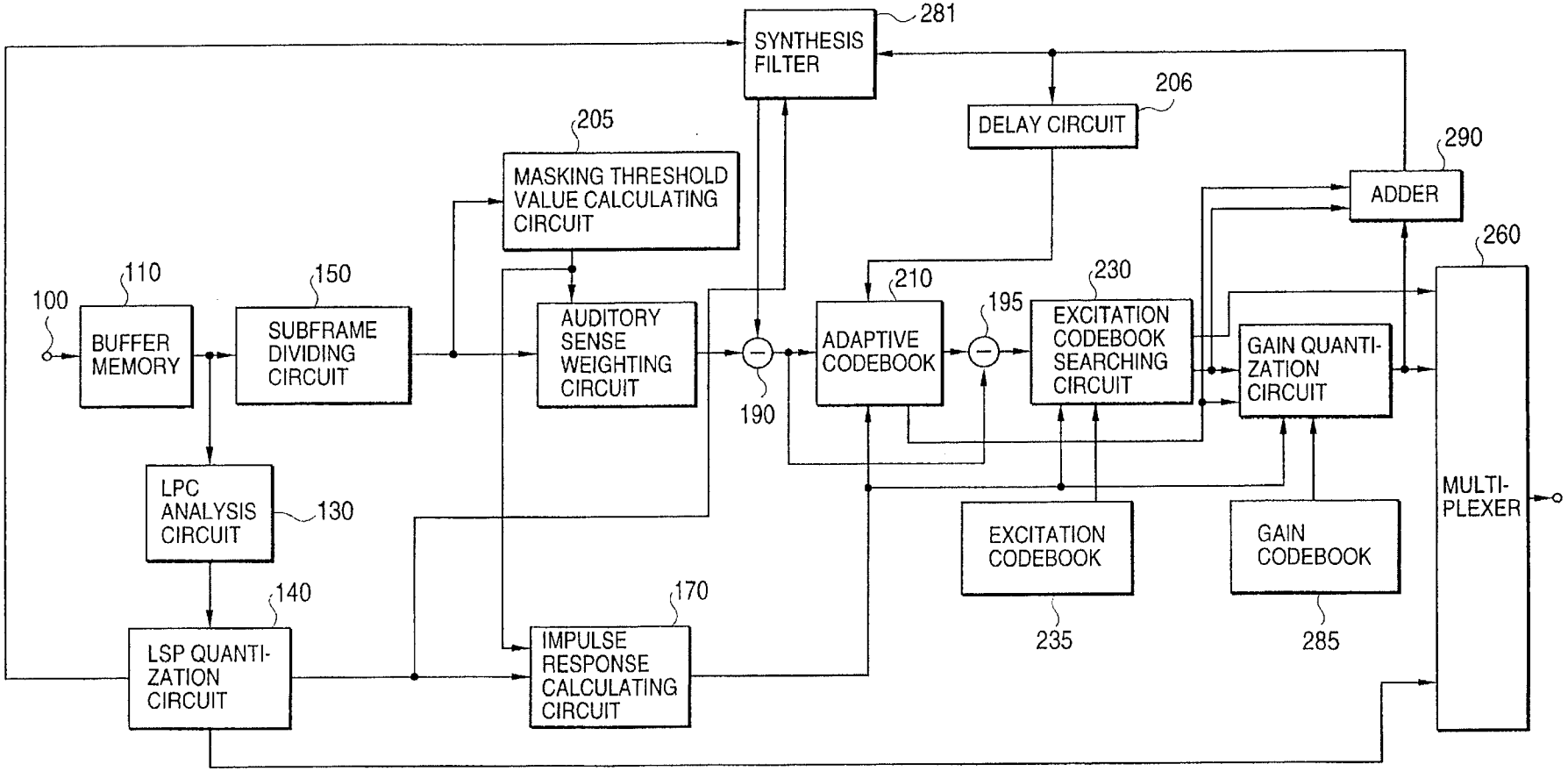
FIG. 5 is a block diagram showing the fifth embodiment of the present invention.

The fifth embodiment is a case of providing the auditory sense weighting circuit 220 of the first embodiment ahead of the adaptive codebook 210 as shown in FIG. 5 and searching an adaptive code vector with an auditory sense weighted signal. In addition, auditory sense weighting is conducted before searching of an adaptive code vector in the fifth embodiment. All searching after this step, for example, searching of the excitation codebook, is also conducted with an auditory sense weighted signal.

Input voice signals are weighted in the auditory sense weighting circuit 220 in the same manner as that in the first embodiment. The weighted signals are subtracted by outputs of the synthesis filter 281 in the subtracter 190, and input to the adaptive codebook 210.

The adaptive codebook 210 calculates delay M and gain β of the adaptive codebook that minimizes the following equation.

$$D=\sum_{n=0}^{N-1}[x'_{zm}(n)-\beta\cdot V(n-M)*h_{wm}(n)]^2 \quad (12)$$

Where, $x'_{wm}(n)$ is an output signal of the subtracter 190, and $h'_{wm}(n)$ is an output signal of the impulse response calculating circuit 170.

Then, the output signal of the adaptive codebook is input to the subtracter 195 in the same manner as the first embodiment and used for searching of the excitation codebook.

The above is the explanation of the fifth embodiment of the present invention.

It is to be noted that the critical band analysis filters in the above-mentioned embodiments can be substituted by the other well-known filters operating equivalently to the critical band analysis filters.

Also, the calculation methods for the masking threshold values can be substituted by the other well-known methods.

Furthermore, the excitation codebook can be substituted by the other well-known configuration. For the configuration of the excitation codebook, it is possible to refer to the paper titled "On reducing computational complexity of codebook search in CELP coder through the use of algebraic codes" (Proc. ICASSP, pp. 177–180, 1990) by C. Laflamme et al. (reference No. 12) and the paper titled "CELP: A candidate for GSM half-rate coding" (Proc. ICASSP, pp. 469–472, 1990) by I. Trancoso et al. (reference No. 13).

Furthermore, the more effective codebooks by matrix quantization, finite vector quantization, trellis quantization, delayed decision quantization and so on are used, the better characteristics can be obtained. For more detailed information, it is possible to refer to the paper titled "Vector quantization" (IEEE ASSP Magazine, pp. 4–29, 1984) by Gray (reference No. 14) and so on.

The explanation of the above embodiment is of a 1-stage excitation codebook. However, the excitation codebook could also be multi-stated, for example, 2-staged. This kind of codebook could reduce complexity of computations required for searching.

Also, the adaptive codebook was given as a first degree, but sound quality can be improved to secondary or higher degrees or by using a decimal value instead of an integer as delay values. For details, the paper titled, "Pitch predictors with high temporal resolution" (Proc. ICASSP, pp. 661–664, 1990) by P. Kroon et al. (Reference No. 15), and so on can be referred to.

In the above embodiment, LSP parameters are coded as the spectrum parameters and analyzed by LPC analysis, but other common parameters, for example, LPC cepstrum, cepstrum, improved cepstrum, generalized cepstrum, mel-cepstrum or the like can also be used for the spectrum parameters.

Also, the optimal analysis method can be used for each parameter.

In vector quantization of LSP parameters, vector quantization can be conducted after nonlinear conversion is conducted on LSP parameters to account for auditory sense characteristics. A known example of nonlinear conversion is Mel conversion.

It is also possible to have a configuration by which LPC coefficients calculated form frames may be interpolated for each subframe in relation to LSP or in relation to linear predictive coefficients and use the interpolated coefficients in searches of the adaptive codebook and the excitation codebook. Sound quality can be further improved with this type of configuration.

Auditory sense weighting based on the masking threshold values indicated in the embodiments can be used for quantization of gain codebook, spectral parameters and LSP.

Also, when determining auditory sense weighting filters, it is possible to use masking threshold values from simultaneous masking together with masking threshold values from successive masking.

Furthermore, instead of determining auditory sense weighting coefficients directly form masking threshold values, it is possible to multiply masking threshold values by weighting coefficients and then convert the results to auditory sense weighting filter coefficients.

Other common configurations for auditory sense weighting filter can also be used.

Next, the sixth embodiment is explained.

Figure 6:
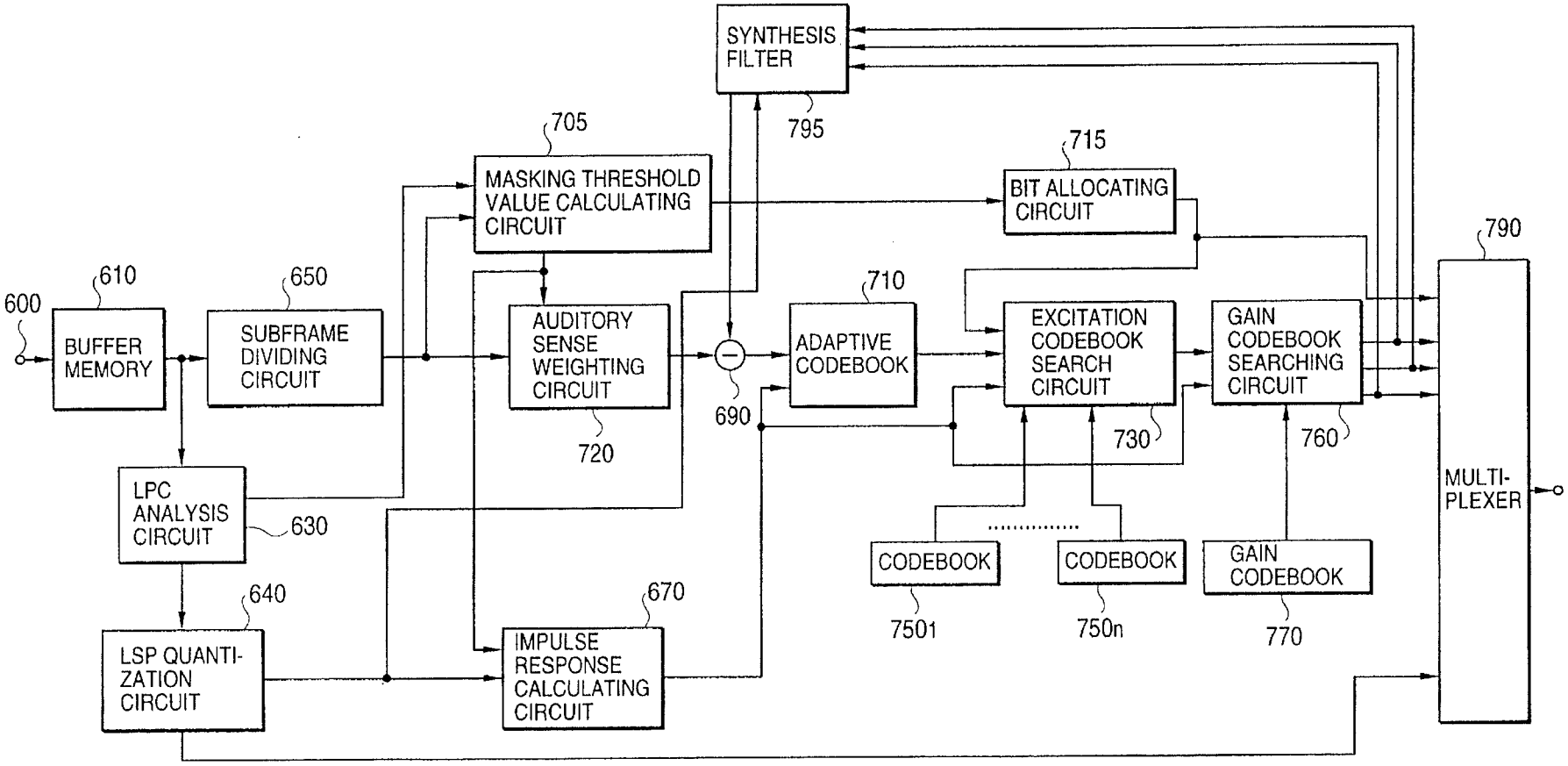
FIG. 6 is a block diagram showing the sixth embodiment.

FIG. 6 is a block diagram showing the sixth embodiment. Here, for simplicity, an example of allocating number of bits of codebooks based on masking threshold values at searching excitation codebooks is shown. However, it can be applied for adaptive codebooks and other types of codebooks.

In FIG. 6, at the transmitting side, voice signals are input form an input terminal 600 and one frame of voice signals (20 ms, for example) is stored in a buffer memory 610.

An LPC analyzer 630 conducts well-known LPC analysis from voice signals of the stored frames and calculates LPC parameters that represent spectral characteristics of framed voice signals for a preset number of letters L.

Then, an LSP quantization circuit 640 quantizes the LSP parameters in a preset number of quantization bit and outputs the obtained code lk to a multiplexer 790. The code is decoded and transformed to the linear prediction coefficient $a_i'$ (i=1 to P) and output to an impulse response circuit 670 and a synthesis filter 795. For coding method of LSP parameter said transformation of LSP parameters and linear prediction coefficients, it is possible to refer to the above-mentioned Reference No. 4, etc. In addition, for more efficient quantization of LSP parameters, vector-scaler quantization or other well-known vector quantization methods can be used. For LSP vector-scaler quantization, the above-mentioned Reference No. 5, etc. can be referred to.

A subframe dividing circuit 650 divides framed voice signals into subframes. Here, for example, subframe length is 5 ms for a 20 msec frame length.

A masking threshold value calculating circuit 705 performs FFT transformation to an input signal x(n) of N points and calculates a spectrum x(k) (where, k=0 to N−1). Continuously, it calculates a power spectrum $|X(k)|^2$, analyzes the result by using critical filter models or auditory sense models, and calculates the power of each critical band or RMS. Here, for calculations of power, the following equation is used.

$$B(i) = \sum_{k=bli}^{bhi} |X(k)|^2 \ (i = 1 \text{ to } R) \tag{13}$$

Here, $bl_i$ and $bh_i$ are lower limit frequency and upper limit frequency of i-th critical band, respectively. R represents a number of critical bands included in a voice signal band. For details on the critical band, the above-mentioned Reference No. 8 can be referred to.

Then, spreading functions are convoluted in a critical band spectrum according to the following equation.

$$C_i = \sum_{j=1}^{bmax} B_j sprd(j,i) \tag{14}$$

Here, sprd(j, i) is a spreading function and Reference No. 6 can be referred to for its specific values. $b_{max}$ is a number of critical bands included from 0 to $\pi$ in each frequency.

Next, a masking threshold value spectrum $Th_i$ is calculated using the following equation.

$$T_i = C_i T_i \tag{15}$$

Where $$T_i = 10^{-(oi/10)} \tag{16}$$

$$O_i = \alpha(14.5+i)+(1-\alpha)5.5 \tag{17}$$

$$\alpha = \min[(NG/R)_3 1.0] \tag{18}$$

$$NG = 10\log_{10} \prod_{i=1}^{M} [l - k_i^2] \tag{19}$$

Here, $k_i$ is an i-th k parameter, and it is calculated by transforming a linear prediction coefficient input from the LPC analyzer 630 using a well-known method. M is a number of order of linear prediction analysis.

Considering absolute threshold values, a masking threshold value spectrum is represented as below.

$$T''_i = \max[T_i, \text{absth}_i] \tag{20}$$

Where, $\text{absth}_i$ is an absolute threshold value in an i-th critical band, it can be referred to Reference No. 7.

Next, transforming the frequency axis from the bark axis to the Hz axis, a power spectrum $P_m(f)$ to making threshold value spectrum T·i (i=1 . . . $b_{max}$) is obtained. By performing inverse FFT, auto-correlation function r(j) (j=0 . . . N−1) can be calculated.

Continuously, by performing a well-known linear predicting analysis to the auto-correlation function, a filter coefficient $b_i$ (i=1 . . . P) is calculated.

The auditory sense weighting circuit 720 conducts auditory sense weighting

Using the filter coefficient $b_i$, the auditory sense weighting circuit 720 performs filtering of supplied voice signals with a filter having the transfer characteristics specified by Equation (21), then performs auditory sense weighting to the voice signals and outputs a weighted signal $X_{wm}(n)$.

$$H_{wm}(z) = \left[1 - \sum_{i=1}^{p} b_i r_1^i z^{-1}\right] / \left[1 - \sum_{i=1}^{p} b_i r_2^i z^{-1}\right] \tag{21}$$

Where, $\gamma_1$ and $\gamma_2$ are constants for controlling weighting quantity, they typically meet the criteria $0 \leqq \gamma_2 < \gamma_1 \leqq 1$.

An impulse response calculating circuit 670 calculates an impulse response $h_{wm}(n)$ of a filter having the transfer characteristics of Equation (22) in a preset length, and outputs a result.

$$A_w(z) = H_{wm}(z) \cdot [1/A(z)] \tag{22}$$

Where, $$1/A(z) = 1/\left[1 - \sum_{i=1}^{p} a'_i z^{-1}\right], \tag{23}$$

and $a_i'$ is output from the LSP quantization circuit 640.

A subtracter 690 subtracts the output of the synthetic filter 795 from a weighted signal and outputs a result.

An adaptive codebook 710 inputs the weighted impulse response $h_{wn}(n)$ from the impulse response calculating circuit 670, and a weighted signal from the subtracter 690, respectively. Then, it performs pitch prediction based on long-term correlation, and calculates delay M and gain $\beta$ as pitch parameters.

In the following explanations, the predicting order of the adaptive codebook is 1, however can also be 2 or more. For calculations of delay M in an adaptive codebook one can refer to the above-mentioned Reference No. 1 and No. 2.

Successively, gain $\beta$ is calculated and an adaptive code vector $x_z(n)$ is calculated, according to the following equation, to be subtracted from the output of subtracter 690.

$$x_z(n) = x_{wm}(n) - \beta \cdot v(n-M) * h_{wn}(n) \tag{24}$$

Where, $x_{wm}(n)$ is an output signal of the subtracter 690, v(n) is a past synthesis filter driving signal. $h_{wm}$ (n) is output from the impulse response calculating circuit 670. The symbol * represents convolution integration.

A bit allocating circuit 715 inputs a masking threshold value spectrum $T_i$, $T'_i$ or $T''_i$. Then, it performs bit allocation according to the Equation (25) or the Equation (26).

$$R_j = R + 1/2\log_2 \left\{ \left[\prod_{i=0}^{M-1} SMR_{ij}\right]^{1/M} / \left[\prod_{j=1}^{L} \prod_{i=0}^{M-1} SMR_{ij}\right]^{1/M\times L} \right\} \tag{25}$$

$$R_j = R + 1/2\log_2 \left\{ \left[\prod_{i=0}^{M-1} SMR_{ij}\right] / \left[\prod_{j=1}^{L} \prod_{i=0}^{M-1} SMR_{ij}\right]^{1/L} \right\} \tag{26}$$

Where, to set the number of a bits of whole frame to a preset value as shown by the Equation (27), the number of bits is adjusted so that the allocated number of bits of subframes is in the range from the lower limit number of bits to the upper limit number of bits.

$$\sum_{j=1}^{L} R_j = R_r \tag{27}$$

$$R_{min} < R_j < R_{max}$$

Where, $R_j$, $R_T$, $R_{min}$, $R_{max}$ represent the allocated number of bits of j-th subframe, the total number of bits of whole frames, the lower limit number of bits of a subframe and the upper limit number of bits of the subframe, respectively. L represents a number of subframes in a frame.

As a result of the above processing, bit allocation information is output to the multiplexer 790.

The excitation codebook searching circuit 730 having codebooks 750 to 750N of which numbers of bits are different from others, inputs allocated numbers of bits of respective subframes and switches the codebooks (750$_1$ to 750$_N$) according to the number of bits. It also selects an excitation code vector that minimizes the following equation.

$$E_k = \sum_{n=0}^{N-1} [X_{zm}(n) - r_k \cdot c_k(n) * h_{wm}(n)]^2 \tag{28}$$

Where, $\gamma_k$ is an optimal gain to a code vector $c_k(n)$ (j=0 . . . $2^B-1$, and where B is the number of bits of excitation codebook). $h_{wm}(n)$ is an impulse response calculated with the impulse response calculator 670.

It is possible, for example, to prepare the excitation codebook using a Gaussian random number as shown in Reference No. 1, or by training in advance. For the codebook configuration method by training, for example, it is possible to refer to the paper titled "An Algorithm for Vector Quantization Design" (IEEE Trans. COM-28, pp. 84–95, 1980) by Linde et al.

The gain codebook searching circuit 760 searches and outputs a gain code vector that minimizes the following equation using a selected excitation code vector and the gain codebook 770.

$$E_k = \sum_{n=0}^{N-1} \begin{bmatrix} X_{wm}(n) - g_{1k}v(n-T) * h_{wm}(n) \\ -g_{2k}c(n) * h_{wm}(n) \end{bmatrix}^2 \tag{29}$$

Where, $g_{1k}$, $g_{2k}$ are k-th quadratic gain code vectors.

Next, indexes of the selected adaptive code vector, the excitation code vector and the gain code vector are output.

The multiplexer 790 combines the outputs of the LSP quantization circuit 640, the bit allocating circuit 715 and the gain codebook searching circuit 760 and outputs a result.

The synthetic filter circuit 795 calculates a weighted regeneration signal using an output of the gain codebook searching circuit 760, and outputs a result to the subtracter 690.

The above is the explanation of the sixth embodiment.

Next, the seventh embodiment is explained.

Figure 7:
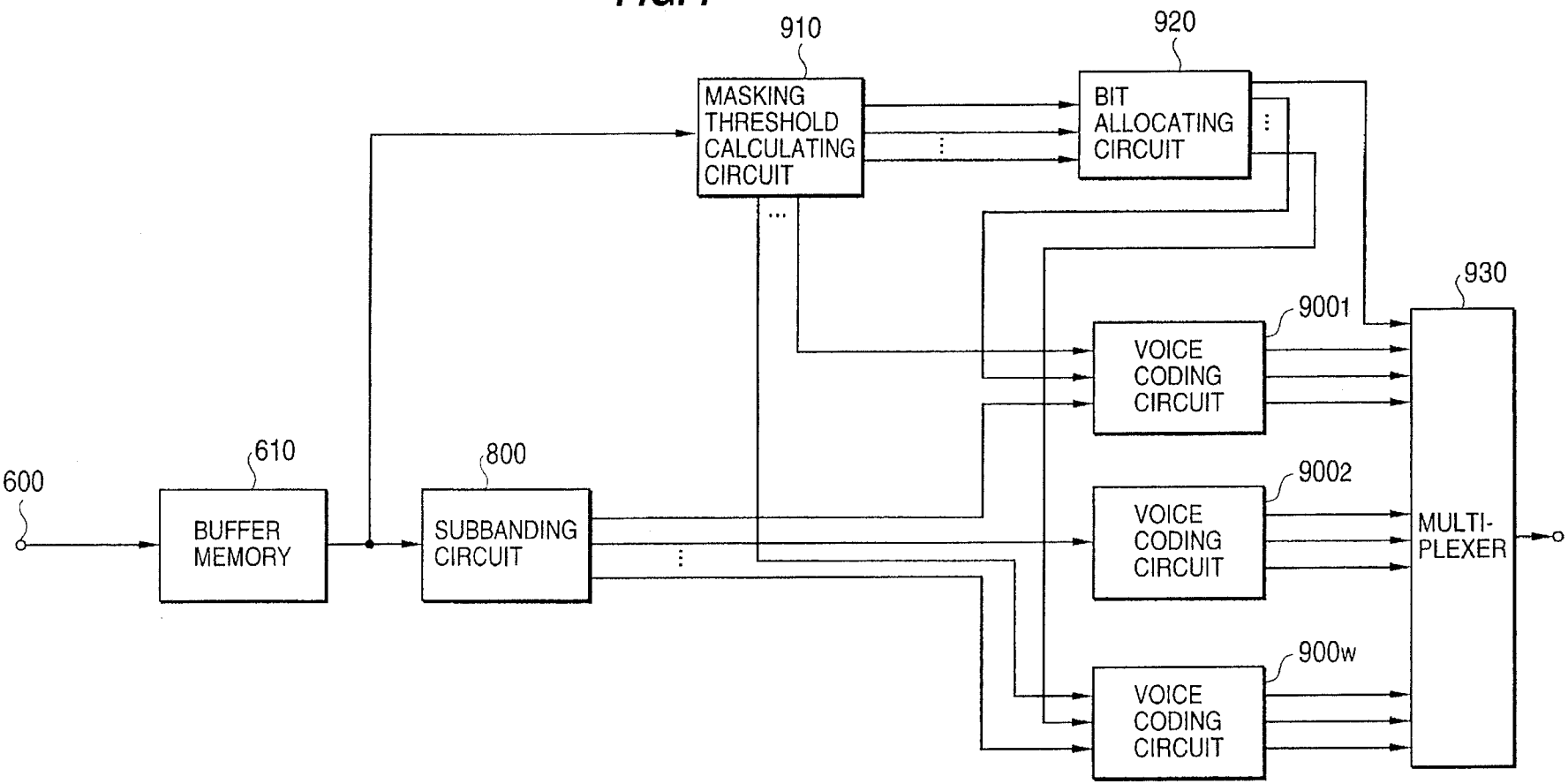
FIG. 7 is a block diagram showing the seventh embodiment.

FIG. 7 is a block diagram showing the seventh embodiment.

Explanation for a component in FIG. 7 referred by the same number as that in FIG. 6 is omitted, because it operates similarly to that of FIG. 6.

A subbanding circuit 800 divides voice signals into a present number of bands, w, for example.

The bandwidth of each band is set in advance. QMF filter bands are used for subbanding. For configurations of the QMF filter bands, it is possible to refer to the paper titled "Multirate digital filters, filter bands, polyphase networks, and applications: A tutorial" (Proc. IEEE, pp. 56–93, 1990) by P. Vaidyanathan et al. (Reference No. 16).

The masking threshold value calculating circuit 910 calculates masking threshold values of each critical band similarly to the masking threshold value calculating circuit 705. Then, according to the Equation (30), it calculates $SMR_{kj}$ using masking threshold values included in each band subbanded with the subbanding circuit 800, and outputs a result to the bit allocating circuit 920.

$$SMR_{kj} = P_{kj}/T_{kj} \tag{30}$$

In addition, it calculates filter coefficient $b_i$ from masking threshold values included in each band in the same manner as that in the masking threshold value calculating circuit 705 of FIG. 6, and outputs a result to the voice coding circuits 900$_1$ to 900$_w$.

According to the Equation (31), the bit allocating circuit 920 allocates a number of bits to each subframe and band using $SMR_{kj}$(j=1 . . . L, k=1 . . . W) supplied by the masking threshold value calculating circuit 910, and outputs a result to the voice coding circuits 900$_1$ to 900$_w$.

$$R_{kj} = R + 1/2\log_2 \left\{ [SMR_{kj}] / \left[ \prod_{j=1}^{L} SMR_{kj} \right]^{1/L} \right\} \tag{31}$$

Where, k and j of $R_{kj}$ represent j-th subframe and k-th band, respectively. Here, j=1 . . . L, k=1 . . . W.

Figure 8:
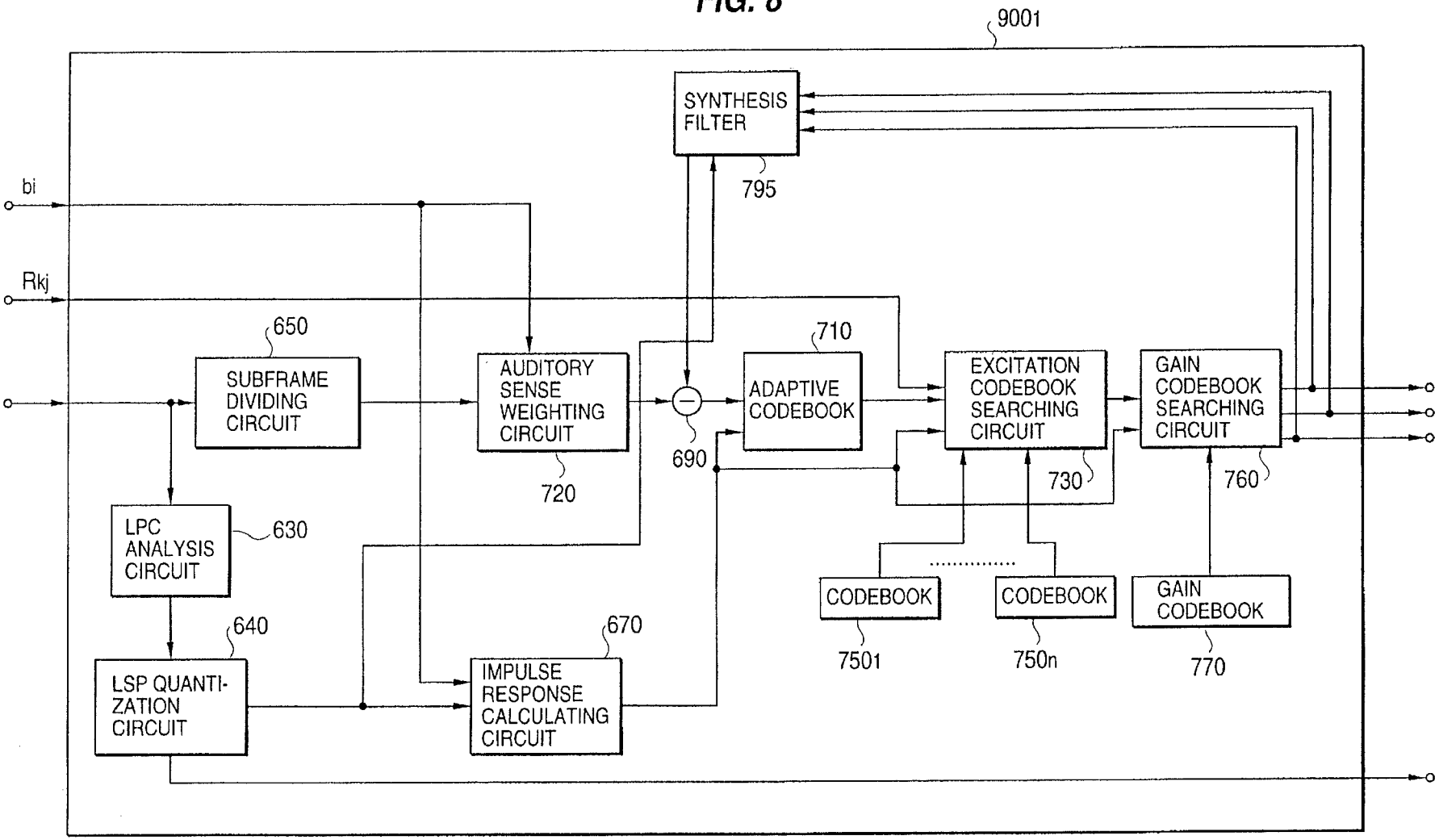
FIG. 8 is a block diagram showing the seventh embodiment.

FIG. 8 is a block diagram showing configurations of the voice coding circuits 900$_1$ to 900$_w$.

Only the configuration of the voice coding circuit 900$_1$ of the first band is shown in FIG. 8, because all of the voice coding circuits 900$_1$ to 900$_w$ operate similarly to each other. Explanation for a component in FIG. 8 referred by the same number as that in FIG. 7 is omitted, because it operates similarly to that of FIG. 7.

The auditory sense weighting circuit 720 inputs the filter coefficient $b_i$ for performing auditory sense weighting, and operates in the same manner as the auditory sense weighting circuit 720 in FIG. 7.

The excitation codebook searching circuit 730 inputs the bit allocation value $R_{kj}$ for each band, and switches number of bits of excitation codebooks.

This is the explanation for the seventh embodiment.

Next, the eighth embodiment is explained.

Figure 9:
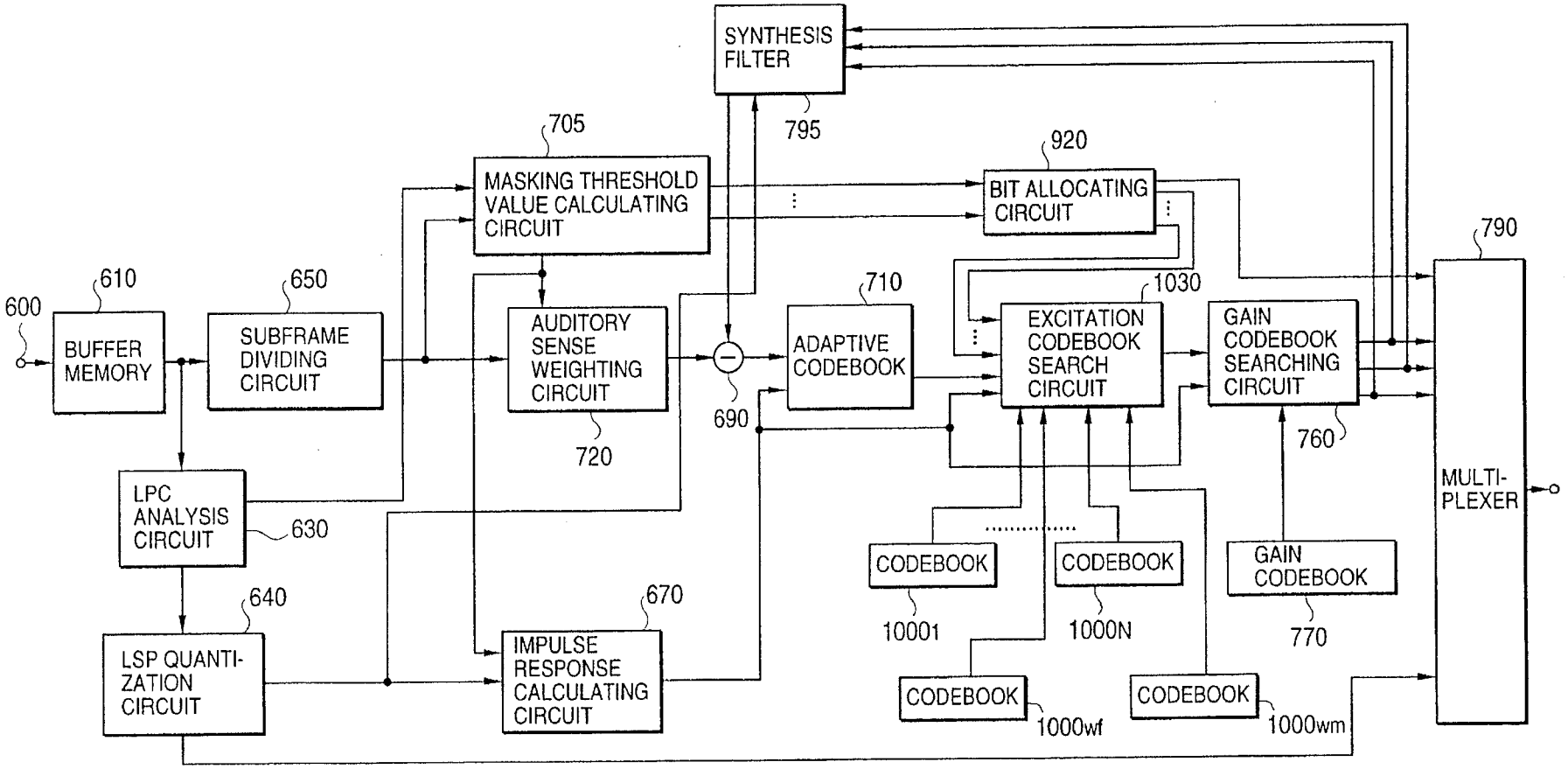
FIG. 9 is a block diagram showing the eighth embodiment.

FIG. 9 is a block diagram showing the eighth embodiment. Explanation for a component in FIG. 9 referred by the same number as that in FIG. 7 or FIG. 8 is omitted, because it operates similarly to that of FIG. 7 or FIG. 8

The excitation codebook searching circuit 1030 inputs bit allocation values for each subframe and band from the bit allocating circuit 920, and switches excitation codebooks for each band and subframe according to the bit allocation values. It has N kinds of codebooks of which number of bits are different, for respective bands. For example, the band 1 has codebooks 1000$_{11}$ to 1000$_{1N}$.

In addition, for each band, impulse responses of concerned subbanding filters are convoluted in all code vectors of a codebook. In the band 1, for example, impulse responses of the subbanding filter for the band 1 are calculated using Reference No. 16, they are convoluted in advance in all code vectors of N codebooks of band 1.

Next, bit allocation values for respective bands are input for respective subframes, a codebook according to the number of bits is read out, code vectors for all bands (w, for this example) are added a new code vector c(n) is created according to the following Equation (32)

$$c(n) = \sum_{i=1}^{W} c_i(n) \tag{32}$$

Then, a code vector that minimizes the Equation (28) is selected.

If searching is done for all possible combinations for all bands of a codebook of each band, tremendous computational operations are needed. Therefore, it is possible to adopt a method of subbanding output signals of adaptive codebooks, selecting a plurality of candidates of code vectors of which distortion is small from concerned codebooks for each band, restoring codebooks of all bands using Equation (32) for each combination of the candidates in all bands, and selecting a code vector that minimizes distortion from all combinations. With this method, computational complexity for searching code vectors can be remarkably reduced.

In the above embodiment, for deciding bit allocation method, it is possible to use a method of clustering SMR in advance, designing codebooks for bit allocation, in which SMR for each cluster and allocation number of bits are configured in a table, for a preset bit number (B bits, for example), an using these codebooks for calculating bit allocation in the bit allocating circuit. With this configuration, transmission information for bit allocation can be reduced because bit allocation information to be transmitted is enough B bits for a frame.

Moreover, in the seventh and eight embodiments, Equation (33) can be used for bit allocation for each subframe and band.

$$R_{kj} = R + 1/2\log_2 \left\{ \left[ \prod_{m=1}^{Q_k} SMR_{kmj} \right] / \left[ \prod_{j=1}^{L} \prod_{m=1}^{Q_k} SMR_{kmj} \right]^{1/QL} \right\} \tag{33}$$

Where, $Q_k$ is a number of critical bands included in k-th subband.

It is to be noted that, in the above embodiments, examples of adaptively allocating numbers of bits of excitation codebooks are shown, however, the present invention can be applied to bit allocation for LSP codebooks, adaptive codebooks and gain codebooks as well as excitation codebooks.

Furthermore, as a bit allocating method in the bit allocating circuits 715 and 920, it is possible to allocate a number of bits once, perform quantization using excitation codebooks by the allocated number of bits, measure quantization noises and adjust bit allocation so that Equation (34) is maximized.

$$MNR_j = \left[ \prod_{j=1}^{M-1} SMR_{ij} \right]^{1/M} / \sigma_{nj}^2 \tag{34}$$

Where, $\sigma_{nj}^2$ is a quantization noise measured by using j-th subframe.

Moreover, as a method for calculating of the masking threshold value spectrum, other well-known methods can be used.

Next, the ninth embodiment is explained.

Figure 10:
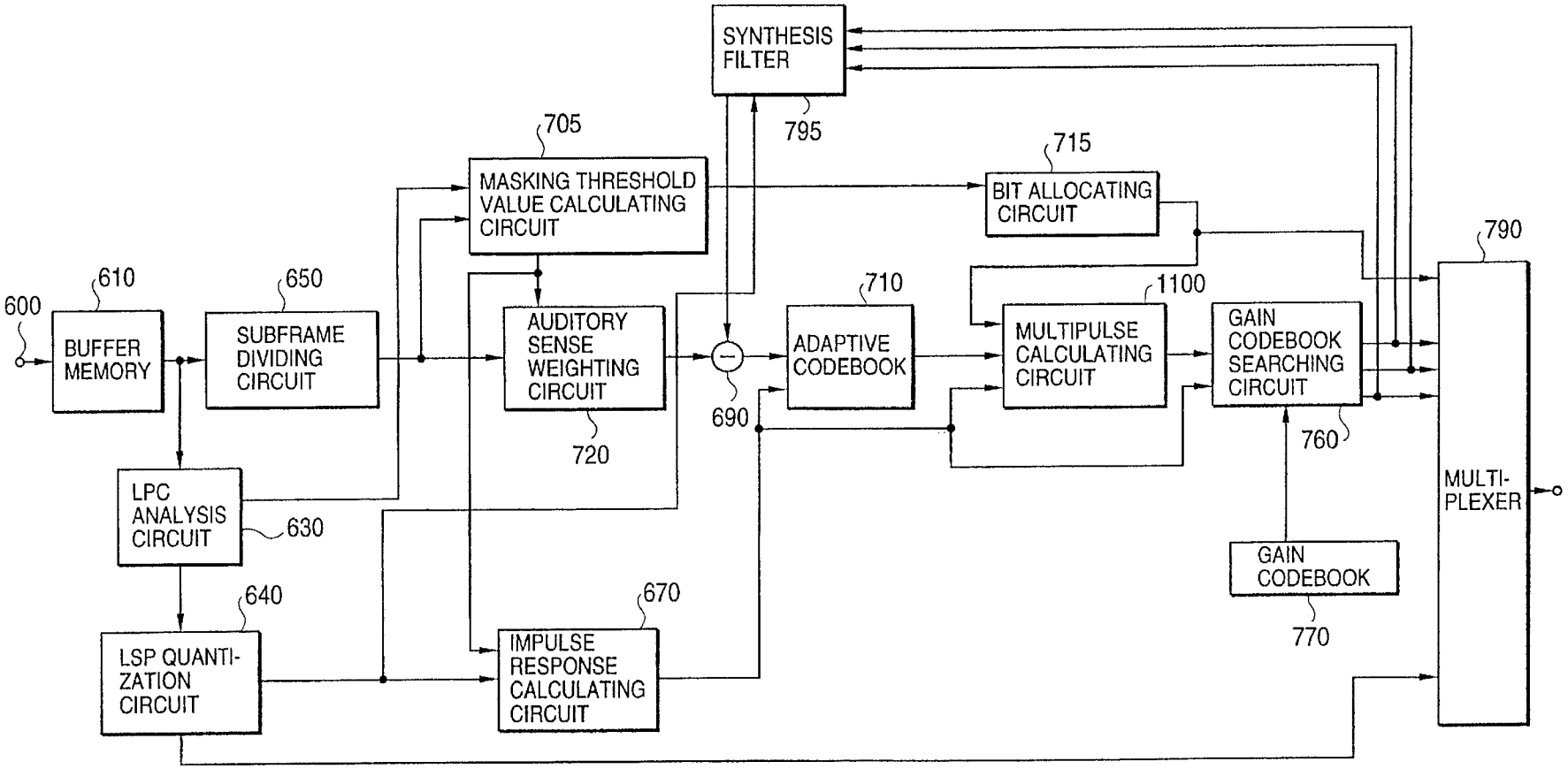
FIG. 10 is a block diagram showing the ninth embodiment.

FIG. 10 is a block diagram showing the ninth embodiment. Explanation for a component in FIG. 10 referred by the same number as that in FIG. 7 is omitted, because it operates similarly to that of FIG. 7.

In the ninth embodiment, a multipulse calculating circuit 1100 for calculating multipulses is provided instead of the excitation codebook searching circuit 730.

The multipulse calculating circuit 1100 calculates amplitude and location of a multipulse based on the Equation (1) in the same manner as the embodiment 4. But, a number of multipulses is dependent on the number of multipulses from the bit allocating circuit 715.

What is claimed is:

1. A voice coder comprising:

masking calculating means for calculating masking threshold values from supplied discrete voice signals based on auditory sense masking characteristics;

auditory sense weighting means for calculating filter coefficients based on said masking threshold values and weighting input signals based on said filter coefficients;

a codebook which includes a plurality of code vectors; and searching means for searching for a code vector in the codebook that minimizes error signal power between an output signal of said auditory sense weighting means and the code vectors in said codebook.

2. The voice coder of claim 1, wherein said codebook is an excitation codebook.

3. The voice coder of claim 1, wherein said codebook is an adaptive codebook.

4. The voice coder of claim 1, further comprising a subbanding means for subbanding said voice signals, wherein said auditory sense weighting means performs weighting to signals that have been subbanded with said subbanding means.

5. The voice coder of claim 4, further comprising:

a bit allocating means for allocating quantization bits to the subbanded signals; and switching means for switching a number of bits of said codebook according to bits allocated with said bit allocating means.

6. The voice coder of claim 1, further comprising a subframe generating means for dividing said voice signals into frames of a first pre-set time length and generating subframes by dividing said frames into second pre-set time length divisions, wherein searching of said codebook is performed for each said subframe.

7. A voice coder comprising:

dividing means for dividing supplied discrete voice signals into first pre-set time length frames;

subframe generating means for generating subframes by dividing said frames into second pre-set time length divisions;

regenerating means for regenerating said voice signals for said subframes based on an adaptive codebook;

masking calculating means for calculating masking threshold values for each of said subframes from said voice signals based on auditory sense masking characteristics;

an auditory sense weighting means for calculating filter coefficients based on said masking threshold values and performing auditory sense weighting to a difference signal formed as a difference between a signal regenerated with said regenerating means and said voice signal based on said filter coefficients;

an excitation codebook which includes a plurality of code vectors; and searching means for searching for a code vector in said excitation codebook that minimizes an error signal power between said auditory sense weighting means and the code vectors in said excitation codebook.

8. The voice coder of claim 7, further comprising a subbanding means for subbanding said voice signals, wherein said auditory sense weighting means performs weighting to a signal that has been subbanded with said subbanding means.

9. The voice coder of claim 8, further comprising:

bit allocating means for allocating quantization bits to the subbanded signals; and switching means for switching a number of bits of said excitation codebook according to bits allocated with said bit allocating means.

10. The voice coder of claim 7, further comprising spectral parameter calculating means for calculating and outputting a spectral parameter representing a spectral envelope of said voice signal for each frame.

11. The voice coder of claim 7, wherein said regenerating means calculates, for each of said subframes, a pitch parameter so that a signal regenerated based on said adaptive codebook which includes past excitation signals approximates said voice signal.

12. The voice coder of claim 7, wherein said adaptive codebook means calculates, for each of said subframes, a pitch parameter so that a signal regenerated based on said adaptive codebook which includes past excitation signals approximates said voice signal.

13. A voice coder comprising:

dividing means for dividing supplied discrete voice signals into pre-set time length frames;

subframe generating means for generating subframes by dividing said frames into pre-set time length divisions;

masking calculating means for calculating masking threshold values for each of said subframes form said voice signals based on auditory sense masking characteristics;

auditory sense weighting means for calculating filter coefficients based on said masking threshold values and performing auditory sense weighting to said voice signals based on said filter coefficients;

adaptive codebook means for calculating an adaptive code vector that minimizes power of a difference signal formed as a difference between a response signal and a voice signal weighted with said auditory sense weighting means;

an excitation codebook which includes a plurality of excitation code vectors; and searching means for searching for a code vector in said excitation codebook that minimizes an error signal power between an output signal generated from said adaptive codebook means and said difference signal.

14. The voice coder of claim 13, further comprising a subbanding means for subbanding said voice signals, wherein said auditory sense weighting means performs weighting to signals subbanded with said subbanding means.

15. The voice coder of claim 14, further comprising:

bit allocating means for allocating quantization bits to the subbanded signals; and switching means for switching a number of bits of said excitation codebook according to bits allocated with said bit allocating means.

16. The voice coder of claim 13, further comprising spectral parameter calculating means for calculating and outputting, for each of said frames, a spectral parameter representing a spectral envelope of said voice signals.

17. The voice coder of claim 13, comprising a spectral parameter calculating means for calculating and outputting, for each of said frames, a spectral parameter representing spectral envelope of said voice signals.

18. A voice coder comprising:

dividing means for dividing supplied discrete voice signals into pre-set time length frames;

subframe generating means for generating subframes by dividing said frames into pre-set time length divisions;

regenerating means for regenerating said voice signals for each of said subframes based on an adaptive codebook;

masking calculating means for calculating masking threshold values from said voice signals based on auditory sense masking characteristics;

auditory sense weighting means for calculating filter coefficients based on said masking threshold values and performing auditory sense weighting to an error signal formed as a difference between said voice signal and a signal regenerated with said regenerating means based on said filter coefficients; and calculating means for calculating a multi-pulse that minimizes an error signal power between an output signal of said auditory sense weighting means and said code vectors in said adaptive codebook.

19. The voice coder of claim 18, further comprising a subbanding means for subbanding said voice signals, wherein said auditory sense weighting means performs weighting to a signal subbanded with said subbanding means.

20. The voice coder of claim 19, further comprising:

a bit allocating means for allocating quantization bits to subbanded signals; and a switching means for switching a number of bits of said excitation codebook according to bits allocated with said allocating means.

21. A method for searching a codebook used for coding discrete voice signals, using signals weighted with masking threshold values calculated from said voice signals based on auditory sense masking characteristics, the method comprising the steps of:

(a) dividing said voice signals into preset time length frames;

(b) generating subframes by dividing said frames into pre-set time length divisions;

(c) regenerating said voice signals for each of said subframes based on an adaptive codebook;

(d) calculating masking threshold values from said voice signals based on auditory sense masking characteristics;

(e) calculating filter coefficients based on said masking threshold values and performing auditory sense weighting to an error signal between a signal regenerated in the step (c) and said voice signal, based on said filter coefficients; and (f) searching for an excitation code vector in an excitation code book that minimizes the error signal power weighted in the step (e).

22. The method for searching a codebook of claim 21, further comprising the step of:

(g) calculating a multi-pulse that minimizes the error signal power weighted in the step (e), instead of the step (f).

23. The method for searching a codebook of claim 21, further comprising the step of:

(g) subbanding said voice signals, wherein the step (d) performs weighting to the subbanded signals.

24. The method for searching a codebook of claim 23, further comprising the step of:

(h) allocating quantization bits to the subbanded signals; and (i) switching a number of bits of said excitation codebook according to bits allocated in the step (h).

25. The method for searching a codebook of used for coding discrete voice signals, using signals weighted with masking threshold values calcualted from said voice signals based on auditory sense masking characteristics, the method comprising the steps of:

(1) dividing said voice signals into preset time length frames;

(2) generating subframes by dividing said frames into pre-set time length divisions;

(3) calculating masking threshold values from said voice signals based on auditory sense masking characteristics;

(4) calculating filter coefficients based on said masking threshold value and performing auditory sense weighting to said voice signal based on said filter coefficients;

(5) calculating, for each of said subframes and using a difference signal formed as a difference between a response signal and a voice signal weighted in the step (4), an adaptive code vector that minimizes a power of said difference signal, and regenerating said voice signal; and (6) searching for an excitation code vector in an excitation code book that minimizes an error signal power between a signal regenerated in the step (5) and said voice signal.

26. The method for searching a codebook of claim 25, further comprising the step of:

(7) calculating a multi-pulse that minimizes the error signal power weighted in the step (5), instead of the step (6).

27. The method for searching a codebook of claim 25, further comprising the step of:

(7) subbanding said voice signals, wherein the step (4) performs weighting to the subbanded signals.

28. The method for searching a codebook of claim 27, further comprising the step of:

(8) allocating quantization bits to the subbanded signals; and (9) switching a number of bits of said excitation codebook according to bits allocated in the step (8).

29. A voice coder comprising:

dividing means for dividing supplied discrete voice signals into frames of a first pre-set time length and further dividing said frames into subframes of a second pre-set time length smaller than said first pre-set time length;

masking calculating means for calculating masking threshold values from said voice signals based on auditory sense masking characteristics;

a plurality of codebooks of which bit numbers are different from each other;

bit number allocating means for allocating a number of bits of said codebooks based on said masking threshold values; and searching means for searching a code vector by switching said codebooks for each of said subframes based on the allocated number of bits.

30. The voice coder of claim 29, wherein said codebooks are excitation codebooks.

31. The voice coder of claim 29, wherein said codebooks are gain codebooks.

32. The voice coder of claim 29, further comprising a subbanding means for subbanding said voice signals.

33. The voice coder of claim 32, wherein impulse responses of subbanding filters are convoluted in each of said codebooks.

34. The voice coder of claim 29, further comprising an auditory sense weighting means for calculating filter coefficients based on said masking threshold values and conducting auditory sense weighting to said voice signals based on said filter coefficients.

35. A voice coder comprising:

dividing means for dividing supplied discrete voice signals into frames of a preset time length;

masking calculating means for calculating masking threshold values from said voice signals based on auditory sense masking characteristics;

pitch calculating means for calculating pitch parameters so as to make signals regenerated based on said adaptive codebooks made of past excitation signals approximate, for each of said subframes, said voice signals;

auditory sense weighting means for calculating filter coefficients based on said masking threshold values and conducting auditory sense weighting to error signals between signals regenerated with said pitch calculating means and said voice signals based on said filter coefficients;

a plurality of excitation codebooks of which bit numbers are different from each other;

bit allocating means for allocating a bit number of said excitation codebooks for each of said subframes based on said masking threshold values; and searching means for switching said excitation codebooks for each of said subframes based on the allocated number of bits and searching for an excitation code vector minimizing an error signal power between an output signal generated from said auditory sense weighting means and code vectors in a switched excitation codebook.

36. The voice coder of claim 35, further comprising subbanding means for subbanding said voice signals, wherein said bit allocating means allocates a bit number to subbanded signals.

37. The voice coder of claim 36, wherein impulse responses of subbanding filters are convoluted in said codebooks.

38. A voice coder comprising:

dividing means for dividing supplied discrete voice signals into frames of a first pre-set time length and further dividing said frames into subframes of a second pre-set time length smaller than said first pre-set time length;

masking calculating means for calculating masking threshold values from said voice signals based on auditory sense masking characteristics;

deciding means for deciding a number of multipulses for each of said subframes based on said masking threshold values; and means for representing excitation signals of said voice signals in a form of multipulse using the number of multipulses decided for each of said subframes.

39. The voice coder of claim 38, further comprising subbanding means for subbanding said voice signals, wherein said deciding means decides the number of multipulses for each subbanded signal.

40. The voice coder of claim 38, further comprising an auditory sense weighting means for calculating filter coefficients based on said masking threshold values and conducting auditory sense weighting to said voice signals based on said filter coefficients.

41. A voice coder comprising:

dividing means for dividing supplied discrete voice signals into frames of a first pre-set time length;

means for generating subframes by dividing said frames into divisions of a second pre-set time length;

masking calculating means for calculating masking threshold values form said voice signals based on auditory sense masking characteristics;

pitch calculating means for calculating pitch parameters so as to make signals regenerated based on said adaptive codebooks made of past excitation signals approximate, for each of said subframes, said voice signals;

auditory sense weighting means for calculating filter coefficients based on said masking threshold values and conducting auditory sense weighting to error signals between signals regenerated with said pitch calculating means and said voice signals based on said filter coefficients;

deciding means for deciding a number of multipulses for each of said subframes based on said masking threshold values; and means for calculating a multipulse minimizing said error signal power using the number of multipulses decided for each of said subframes and representing excitation signals of said voice signals using said multipulse.

42. A method of searching codebooks comprising the steps of:

(a) dividing supplied discrete voice signals into frames of a first pre-set time length and further dividing said frames into subframes of a second pre-set time length;

(b) calculating masking threshold values from said voice signals based on auditory sense masking characteristics;

(c) allocating a bit number of a codebook to each of said subframes; and (d) searching for a code vector for each of said subframes using a codebook having the allocated bit number.

43. The method of searching codebooks of claim 42, wherein said codebooks are excitation codebooks.

44. The method of searching codebooks of claim 42, wherein said codebooks are gain codebooks.

45. The method of searchign codebooks of claim 42, wherien the step (a) is a step of dividing and subbanding supplied discrete voice signals into frames of the first pre-set time length and further dividing said frames into subframes of the second pre-set time length, and the steps (b) to (d) are conducted in each band.

46. The method of searching codebooks of claim 45, wherein impulse responses of subbanding filters are convoluted in advance.

47. A multipulse calculating method comprising the steps of:

(a) dividing and subbanding supplied discrete voice signals into frames of a first pre-set time length and further dividing said frames into subframes of a second pre-set time length;

(b) calculating masking threshold values from said voice signals based on audtory sense masking characteristics, and dividing supplied discrete voice signals into frames of the first pre-set time length and further dividing said frames into subframes of the second pre-set time length;

(c) deciding a number of multipulses for each of said subframes based on said masking threshold values; and (d) calculating a multipulse minimizing said error signal power usign a number of multipulses decided for each of said subframes and representing excitation signals of said voice signals using said multipulse.

48. The multipulse calculating method of claim 47, wherein the step (a) is a step of dividing and subbanding supplied discrete voice signals into frames of the first pre-set time length and further dividing said frames into subframes of the second pre-set time length, and the steps (b) to (d) are conducted in each band.

* * * * *